US005906423A

United States Patent [19]

Lyu

[11] Patent Number: 5,906,423

[45] Date of Patent: May 25, 1999

[54] REFRIGERATOR HAVING EASY OPEN DOOR

[75] Inventor: Gang Lyu, Incheon, Rep. of Korea

[73] Assignee: Daewoo Electronics Co., Ltd., Seoul, Rep. of Korea

[21] Appl. No.: 09/050,980

[22] Filed: Mar. 31, 1998

[30] Foreign Application Priority Data

Aug. 29, 1997 [KR] Rep. of Korea ..... 97-42640

[51] Int. Cl.[6] ..... A47B 97/00

[52] U.S. Cl. ..... 312/405; 220/231; 454/195

[58] Field of Search ..... 312/401, 405; 454/195, 358; 220/231

[56] References Cited

U.S. PATENT DOCUMENTS 2,810,493 10/1957 Eichhorn et al. ..... 220/231
3,186,580 6/1965 Previte ..... 220/231
3,811,650 5/1974 Dehar ..... 220/231
5,573,323 11/1996 Kim et al. .

*Primary Examiner*—Peter M. Cuomo
*Assistant Examiner*—Gerald A. Anderson
*Attorney, Agent, or Firm*—Jacobson, Price, Holman & Stern, PLLC

[57] ABSTRACT

A refrigerator having a door for loading/unloading goods to be stored into/from a chamber is comprised of a handle 20 provided at a front surface of the door 112 with a first end 24 of the handle 20 connected with the door 112 by a hinge 21, an air passage 30 formed at a predetermined area of the door 112 which corresponds opposite to a second end 26 of the handle 20 for receiving outside air at the onset of opening the door 20, a sealable member 40 which is connected to the second end 26 of the handle 20 and is inserted in the air passage 30, and the sealable member 40 blocks the air passage 30 when the door 112 is closed and opens the air passage 30 at the onset when the door 112 is opened, and a net shape support member 50 connected with a second end 26 of the sealable member 40 for enabling the sealable member 40 to be elongated when the door 112 is being opened.

9 Claims, 4 Drawing Sheets

REFRIGERATOR HAVING EASY OPEN DOOR

BACKGROUND OF THE INVENTION

1. Field of the Invention

The present invention relates to a refrigerator. More specifically, the invention relates to a refrigerator having easy open door in which an air passage formed at the door is opened by the pulling of a handle at the opening of the door, and the outside air flows into a goods receiving chamber.

2. Description of the Prior Art

Generally, a refrigerator utilizes a goods receiving chamber of the refrigerator as a cold source and outside of the refrigerator as a hot source. Saturated vapor or working fluid having a low evaporation point is compressed by a compressor to enter a condenser. The potential heat of the high temperature and pressure vapor is rejected to the outside and is changed into the liquid. The working liquid flows through a capillary tube to acquire a low temperature and pressure and then enters to an evaporator. The working fluid in the evaporator absorbs the heat from the goods receiving chamber, and changes into a evaporated vapor. A series of these processes repeats to maintain the temperature of the goods receiving chamber at a proper low temperature.

FIG. 4 illustrates a refrigerator 100 having a conventional handle. A door 112 is provided for closing/opening a goods receiving chamber (not shown) of a body 111, and a handle is provided at a front surface of the door 112 for enabling the door 112 to be easily opened.

Further, a gasket 113 is attached along the front edge of the body 111, on which the door 112 makes contact. A magnet (not shown) is housed in the gasket 113.

Therefore, the door 112 moves toward the body 111 owing to the magnetic force of the magnet when the door 112 is being closed. The contact of the door 112 to the body 111 is maintained, thus enabling the door 112 to remain closed.

The goods may be removed from the goods receiving chamber or put into the goods receiving chamber, and thereafter no cool air in the refrigerator 100 escapes.

However, according to the conventional refrigerator, the user repeatedly and consecutively opens/closes the door 112 in a short time, and the outside air having a relative high temperature rather than the lower temperature inside of the refrigerator flows into the refrigerator 100. The volume is significantly reduced when the warm air is changed into the cool air. The magnetic force is strongly applied between the body 111 and the door 112, and when the door is opened some inconvenience during opening of the door occurs. At worst, the body 111 of the refrigerator 100 is moved forward following the movement of the door 112.

A refrigerator for solving the above problems is disclosed at U.S. Pat. No. 5,573,323. However, the refrigerator still has a problem employing an excessive number of components.

SUMMARY OF THE INVENTION

Therefore, it is an object of the present invention to provide a refrigerator having easy open door which solves the problem.

It is another object of the present invention to provide a refrigerator having easy open door which causes the outside and inside of the refrigerator to be in an equilibrium of pressure by the inflow of outside air into the refrigerator before the onset of the opening of the door, thus enabling the door to be easily opened.

To achieve the above object of the present invention, a refrigerator is comprised of a handle provided at a front surface of a door with a first end of the handle connected with the door by a hinge, an air passage formed at a predetermined area of the door which corresponds opposite to a second end of the handle for receiving outside air at the onset of opening the door, a sealable member which is connected to the second end of the handle and is inserted in the air passage wherein the sealable member blocks the air passage when the door is closed and opens the air passage at the onset when the door is opened, and a net shape support member connected with a second end of the sealable member for enabling the sealable member to be elongated when the door is being opened.

Further, an elastic member is disposed between the handle and the door. A first end of the elastic member is mounted on the predetermined outer surface of the door and a second end of the elastic member elastically pushes a support tab formed at the second end of the handle when the second end of the handle is moved away from the air passage.

Further, a protrusion is formed at the first end of the handle to limit the movement of the handle, and a stopper is formed at the hinge mounted on the door.

Furthermore, a sloped surface is provided at the first end of the handle and the inlet portion of the air passage respectively, so that noise occurring upon contact is reduced due to the retorsion movement of the handle and the air passage is sealably blocked, and a rubber packing is interposed between the slope surfaces.

DETAILED DESCRIPTION OF THE PREFERRED EMBODIMENT

Hereafter, the invention will be described in further detail with reference to the accompanying drawings.

Figure 1:
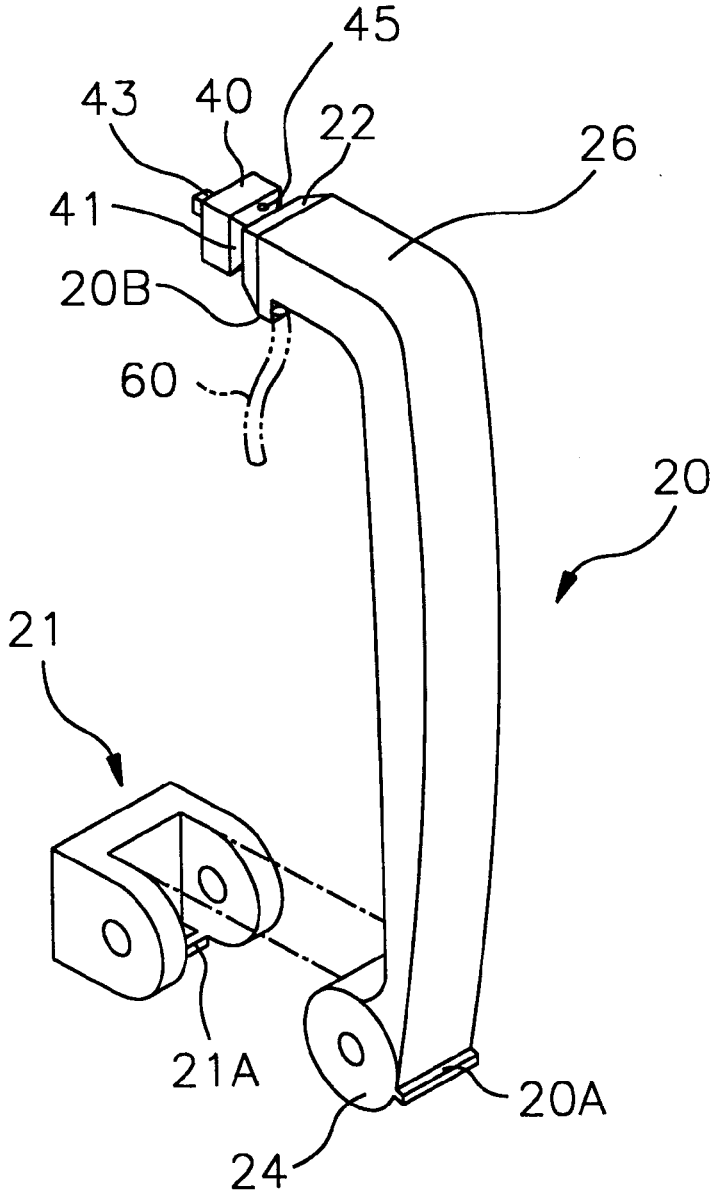
FIG. 1 is a perspective view of a handle of easy open door of a refrigerator according to the present invention.
Figure 2:
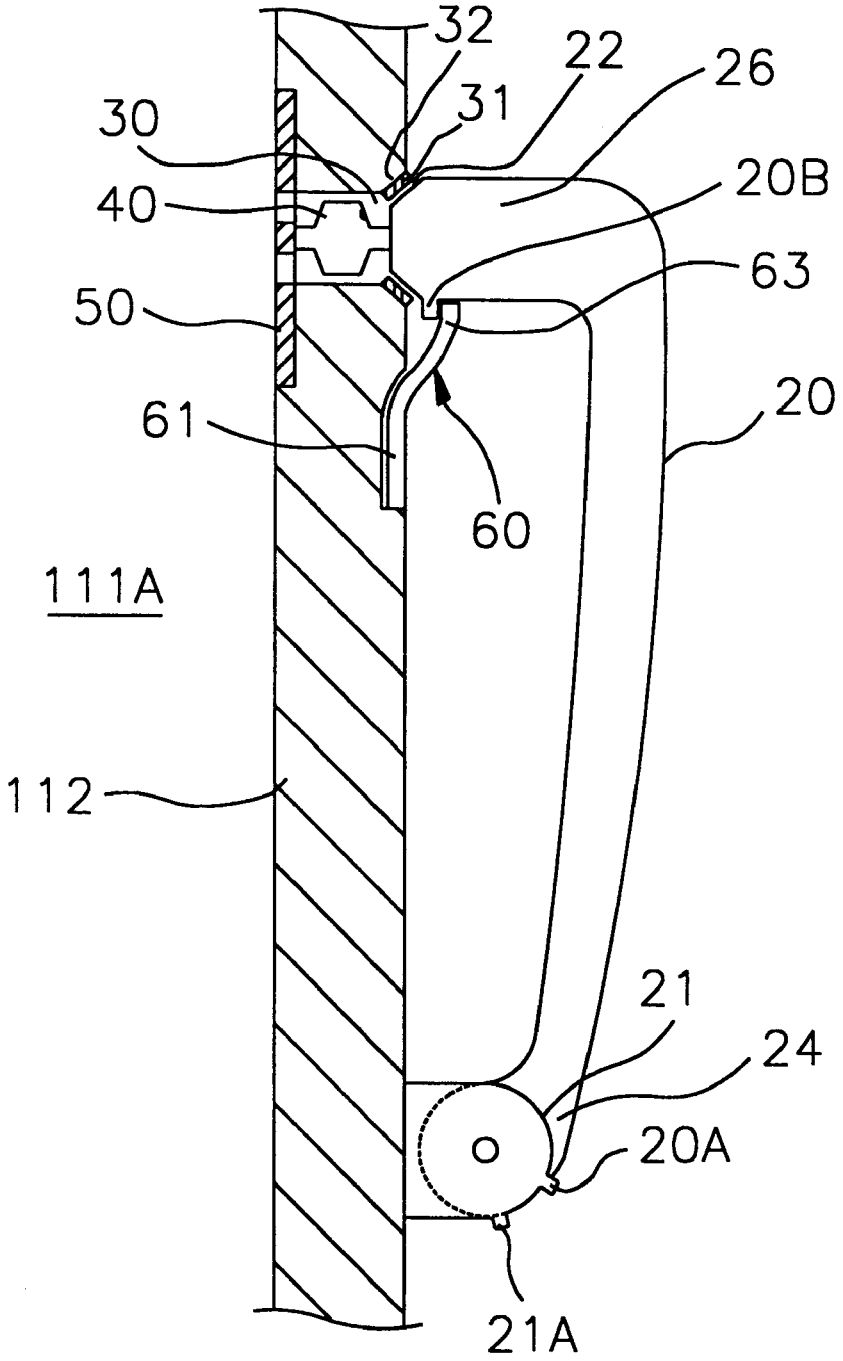
FIG. 2 is a side cross-sectional view of the handle of FIG. 1 when the door is closed.
Figure 3:
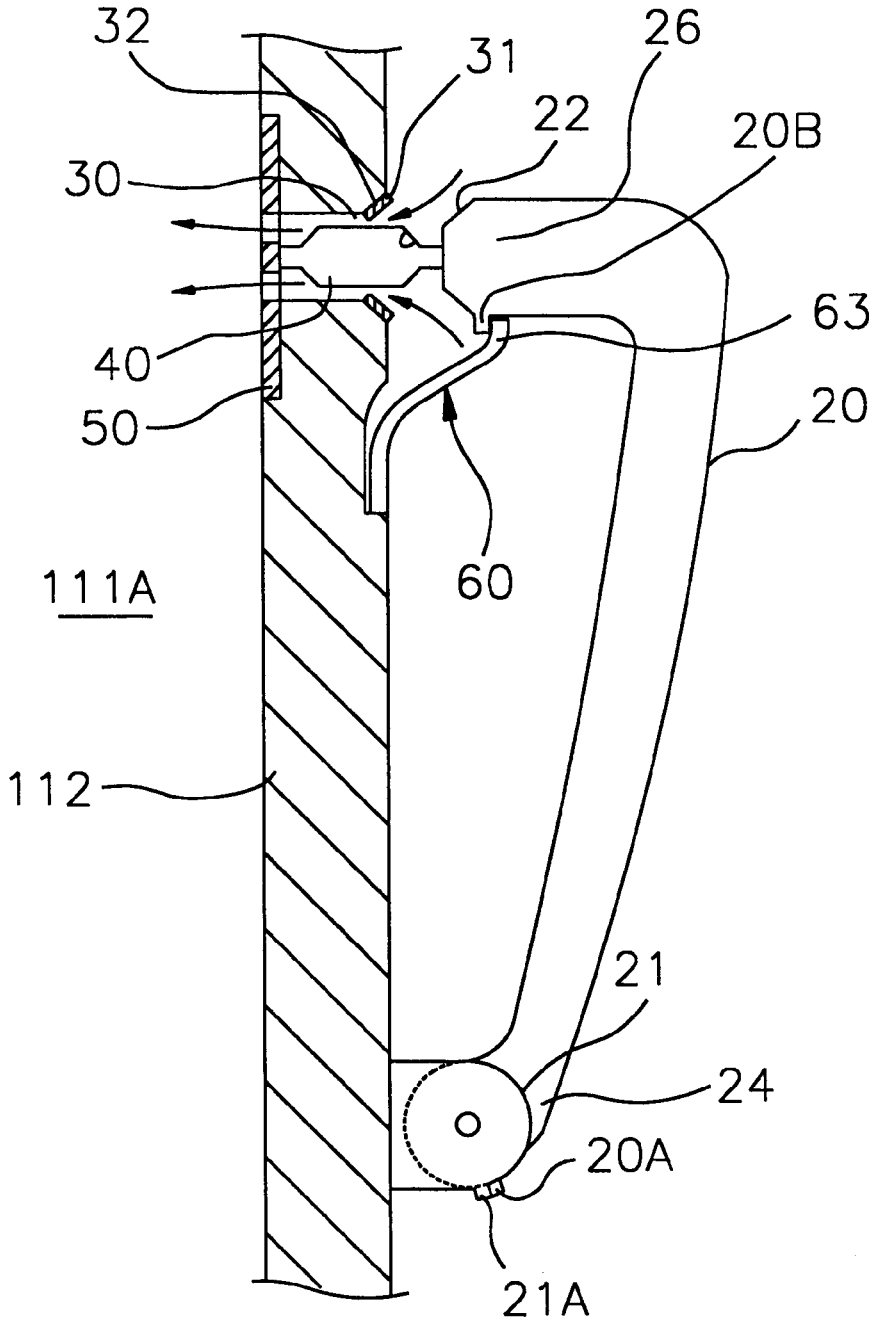
FIG. 3 is a side cross-sectional view of the handle of FIG. 1 when the door is opened.
Figure 4:
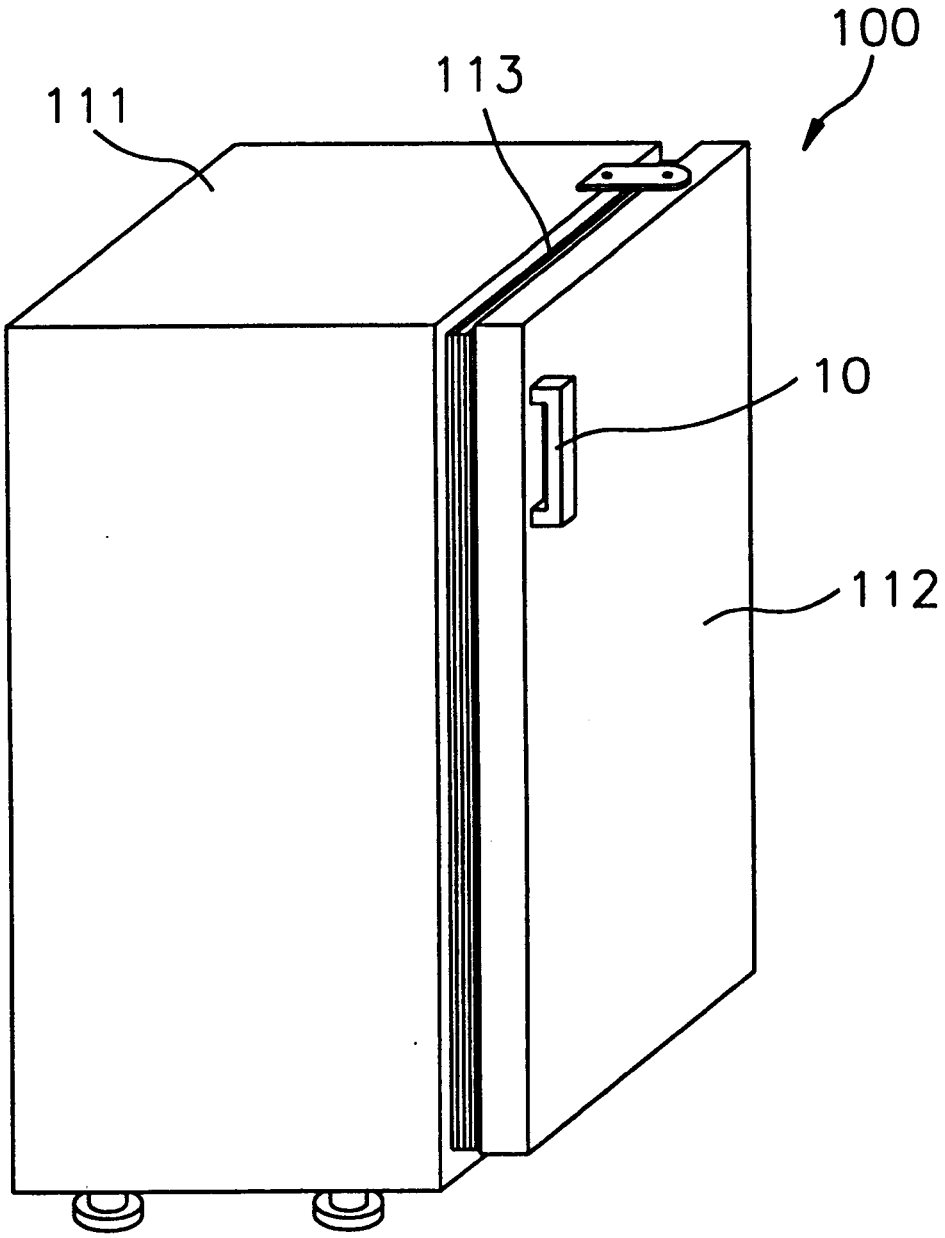
FIG. 4 PRIOR ART
FIG. 4 is a perspective view of a refrigerator according to a prior art.

FIGS. 1, 2 and 3 illustrate a refrigerator having easy open door according to the present invention. The component parts as those in the present invention are designated by the same reference numerals as the corresponding parts of the conventional embodiment, so a detailed description of those parts will be omitted.

The refrigerator is comprised of a door 112 for closing/opening a goods receiving chamber 111A, an air passage 30 formed in the door 112 for enabling outside air to flow into the goods receiving chamber 111A, and a sealable member 40 for blocking the air passage when the goods receiving chamber 111A is closed by the door 112, and for opening the air passage 30 when the goods receiving chamber 111A is opened.

The sealable member 40 is formed at a handle 20 mounted on the front surface of the door 112. A first end 24 of the handle 20 is connected to a hinge 21 mounted on the front surface of the door 112, while a second end 26 of the handle

20 is a first end 41 of the sealable member 40 to cooperate during operation of the handle 20.

The sealable member 40 is comprised of a corrugated sleeve of which a top and a bottom are blocked. A second end 43 of the sealable member 40 is connected to a net 50 covering the air passage 30.

The sealable member 40 has an opening 45 through which the outside air flows into the sealable member 40 during an elongating mode of the sealable member 40, and the air in the sealable member 40 flows out during a normal configuration mode of the sealable member 40.

Further, an elastic member 60 is disposed between the handle 20 and the door 112. A first end 61 of the elastic member 60 is mounted on an outer surface of the door 112 and a second end 63 of the elastic member 60 elastically pushes a support tab 20B formed at the second end 26 of the handle 20 when the second end 26 of the handle 60 is moved away from the air passage 30.

A protrusion 20A is formed at the first end 24 of the handle 20 to limit the movement of the handle 20 and a stopper 21A is formed at a lower portion of the hinge 21. Therefore, a sloped rim 22 of the second end 26 of the handle 20 contacts with a corresponding outer sloped rim 32 of the air passage 30 to seal the air passage 30.

Further, a rubber packing 31 is interposed between the sloped rim 22 of the second end 26 of the handle 20 and the outer sloped rim 32 of the air passage 30 so that noise occurring upon contact is reduced due to the retorsion movement of the handle, and thus the air passage is sealably blocked.

The door of the refrigerator having the handle according to the present invention constructed as above is operated as below.

FIG. 2 shows when the door 112 closes the goods receiving chamber 112. The second end 63 of the elastic member shaped by a plate spring which is mounted on the front surface of the door 112 presses the support tab 20B of the second end 26 of the handle 20. Therefore, the sealable member 40 shaped as a corrugated sleeve which is housed in the air passage 30 blocks the air passage 30. The outside air can not enter into the goods receiving chamber 112.

Thereafter, when the handle 20 is pulled to open the door 112, the first end 24 of the handle 20 is hinged by the hinge 21 as shown in FIG. 3. The second end 26 of the handle 20 moves away from the front surface of the door 112. Thus, the sealable member 40 which is connected with the second end 26 of the handle 20 is elongated. When the blocked air passage 30 is opening, the outside air flows into the goods receiving chamber 111A. Therefore, since no pressure difference between the outside of the refrigerator and the inside of the refrigerator occurs, the door is easily opened.

The force applied to the handle 20 is released after the closing of the door 112, and by the elastic force of elastic member 60 the sloped rim 22 of the second end 26 of the handle 20 is contacted on the rubber packing 31 mounted on the outer rim 32 of the air passage 30 (FIG. 2). Therefore, no cool air leaks from the goods receiving chamber 11A, and the goods stored in the goods receiving chamber 111A are maintained in a proper temperature.

According to the handle of the present invention, since an elongable sealable member for blocking the air passage is formed at the free end of the handle which acts as a hinge, the outside air flows into the goods receiving chamber through the air passage at the onset of the opening of the door. Thus, no pressure difference between the outside and the inside of the refrigerator occurs, thereby opening easily the door.

Further, if the force is released after the closing of the door, the free end of the handle is restored in the original position by the elastic force of the elastic member, and the air passage is blocked, finally maintaining the goods receiving chamber in a sealable condition.

What is claimed is:

1. A refrigerator having a door for loading/unloading goods to be stored into/from a chamber, said refrigerator comprising:

a handle provided at a front surface of said door with a first end of said handle connected with said door by a hinge;

an air passage formed at said door which corresponds opposite to a second end of said handle for receiving outside air upon the commencement of opening said door;

a sealable member which is connected to the second end of said handle and is inserted in said air passage, and said sealable member blocks said air passage when said door is closed and opens said air passage upon commencement of opening said door; and a net shape support member connected with a second end of said sealable member for enabling said sealable member to be elongated when said door is being opened.

2. The refrigerator as set forth in claim 1, wherein an elastic member is disposed between said handle and said door, a first end of said elastic member is mounted on an outer surface of said door and a second end of said elastic member elastically pushes a support tab formed at said second end of said handle when said second end of said handle is moved away from said air passage.

3. The refrigerator as set forth in claim 2, wherein a protrusion is formed at the first end of said handle to limit the movement of said handle and a stopper is formed at said hinge mounted on said door.

4. The refrigerator as set forth in claim 3, wherein a sloped surface is provided at the first end of said handle and the inlet portion of said air passage respectively, so that noise occurring upon contact is reduced due to the retorsion movement of said handle and said air passage is sealably blocked, and a rubber packing is interposed between said slope surfaces.

5. A refrigerator comprising:

a body housing a receiving chamber;

a door for closing/opening said body;

an air passage formed in said door for enabling outside air to flow into said body; and a sealable member for blocking said air passage when said body is closed by said door, and for opening said air passage when said body is opened;

wherein said sealable member formed at a handle of said door and comprised of a corrugated sleeve of which a top and a bottom are blocked; and a first end of said handle hingedly connected to a front surface of said door, and a second end of said handle connected to a first end of said sealable member to cooperate during operation of said handle.

6. The refrigerator as set forth in claim 5, wherein said sealable member has an opening through which the outside air flows into said sealable member at an elongating mode of said sealable member, and the air in said sealable member flows out during a normal configuration mode of said sealable member.

7. The refrigerator as set forth in claim 5, wherein when a force applied to said handle is released a rim of said second end of said handle contacts with a corresponding outer rim of said air passage to seal said air passage.

8. The refrigerator as set forth in claim 7, wherein a restoration action of said handle is provided by an elastic member.

9. The refrigerator as set forth in claim 5, wherein a second end of said sealable member is connected to a net covering said air passage.

* * * * *